US005217076A

United States Patent [19]

Masek

[11] Patent Number: 5,217,076

[45] Date of Patent: Jun. 8, 1993

[54] METHOD AND APPARATUS FOR IMPROVED RECOVERY OF OIL FROM POROUS, SUBSURFACE DEPOSITS (TARGEVCIR ORICESS)

[76] Inventor: John A. Masek, 1547 Gaylord, Denver, Colo. 80206

[21] Appl. No.: 766,350

[22] Filed: Sep. 27, 1991

Related U.S. Application Data

[63] Continuation-in-part of Ser. No. 621,875, Dec. 4, 1990, abandoned.

[51] Int. Cl.[5] ..... E21B 43/24

[52] U.S. Cl. ..... 166/303; 166/50; 166/245; 166/272

[58] Field of Search ..... 166/50, 272, 57, 303, 166/245; 299/2, 19, 4

[56] References Cited

U.S. PATENT DOCUMENTS

| | | | |
|---|---|---|---|
| 3,040,809 | 6/1962 | Pelzer | 166/303 |
| 3,983,939 | 10/1976 | Brown et al. | 166/269 |
| 4,007,786 | 2/1977 | Sehlinger | 166/303 X |
| 4,022,279 | 5/1977 | Driver | 166/272 X |
| 4,099,570 | 7/1978 | Vandergrift | 166/50 X |
| 4,227,743 | 10/1980 | Ruzin et al. | 166/272 |
| 4,257,650 | 3/1981 | Allen | 166/245 X |
| 4,265,485 | 5/1981 | Boxerman et al. | 299/2 |
| 4,384,613 | 5/1983 | Owen et al. | 166/245 X |
| 4,410,216 | 10/1983 | Allen | 166/50 X |
| 4,463,988 | 8/1984 | Bonek et al. | 166/50 X |
| 4,479,541 | 10/1984 | Wang | 166/50 X |
| 4,577,691 | 3/1986 | Huang et al. | 166/50 X |
| 5,036,918 | 8/1991 | Jennings, Jr. et al. | 166/272 X |
| 5,082,054 | 1/1992 | Kiamanesh | 166/50 X |

FOREIGN PATENT DOCUMENTS

| | | | |
|---|---|---|---|
| 1072442 | 2/1980 | Canada | 166/272 |

*Primary Examiner*—Hoang C. Dang
*Attorney, Agent, or Firm*—Sherman and Shalloway

[57] ABSTRACT

A method and apparatus for the improved recovery of oil from porous sub-surface deposits such as tar sands comprising mining and drilling a well with upper and lower horizontal rectangular grids extending outward into the deposit and applying steam heat or super heated crude oil vapor through the lower grid and hot pressurized flue gas through the upper grid. The flue gas and steam or super heated crude oil vapor are produced in a generation facility that provides electricity for the installation from turbine generators, the crude oil for super heating being provided by an initial production from the deposit following flue gas injection. Steam condensate is recycled from the recovered oil to the generation facility thereby reducing the water requirements and environmental pollution, and, where super heated crude oil vapor is used, a portion of the produced crude is used for this purpose.

18 Claims, 5 Drawing Sheets

METHOD AND APPARATUS FOR IMPROVED RECOVERY OF OIL FROM POROUS, SUBSURFACE DEPOSITS (TARGEVCIR ORICESS)

BACKGROUND OF THE INVENTION

This application is a continuation-in-part of copending application Ser. No. 07/621,875, filed Dec. 4, 1990, now abandoned, and priority is claimed therefrom.

The recoverable mineral wealth of this planet is bound up with the geological structure of the Earth's crust in such a way that particular rock layers are indicative of particular mineral types. One of the most important and valuable resources to be found are fossil fuels, coal, oil and gas. In fact oil has become so important to the world economy in this century that its continued supply has taken on strategic importance.

Oil is found around the world in many different types of deposits, from pools under pressure beneath salt dome formations that only require the drilling of a well in order to recover it, to rock formations that bind the oil so strongly that the high heat of a retort is required to separate it. One of the larger and more ubiquitous geological formations associated with the presence of oil deposits are the so-called oil and tar sands, sandstone formations where oil of varying viscosity fills the pores between the individual grains of sand that make up the rock. Other formations containing crude oil such as limestone formations, fractured shales, conglomerates and the like exist and would benefit from the method of the present invention.

Such sands, commonly referred to as tar sands, predominate in areas that were, at one time, the beds of prehistoric seas and typically extend from the surface to depths of about 5,000 feet. They are usually bounded by denser shale formations which prevent seepage of the oil away from the sandstone.

Within the United States, significant tar sand formations are found in California and Utah, among other states, with those in Utah ranging in size from tiny patches to areas covering hundreds of square miles. Estimates of the amount of oil in the Utah formations alone range from about 22 to 30 billion barrels. Reserves of this size are significant and too valuable to ignore. However, recovery of this oil has proved to be a difficult, expensive and environmentally messy proposition.

Because the underground pressures in these formations are low and viscosities relatively to extremely high, simple primary recovery means, such as merely drilling a conventional well are non-productive. Also, since the oil is usually a high pour point, hence a high viscosity, secondary means like water flooding are also non-productive. To date, the most effective method employed has been to physically mine the sands then wash them with vast amounts of hot water or solvent to remove the oil. The water or solvent must then be cleaned before it can be returned to the environment or disposed of. In the case of water, it is almost impossible to successfully remove all the oil residue which means that the remaining water must be left to settle or it will foul the environment. When this use of water is added to the fact that many of the tar sand formations are in arid or semi-arid locations it becomes clear how expensive it can be to make adequate use of these deposits.

Prior art oil recovery from tar sands and the other formations noted have also involved the use of a single hole recovery well surrounded by injection wells for the application of steam, flue gas or solvent to force oil into the recovery well. Other well constructions includes radial designs wherein a large diameter shaft is drilled into the formation with steam or flue gas drifts extending radially outward. Such constructions have employed the "huff and puff" method of recovery wherein hot gas is injected into the arms through conduits to heat and pressurize the formation, then the pressure is released allowing the oil to flow out through the arms into a reservoir at the bottom of the shaft for pumping to the surface through a conduit.

PRIOR ART

Prior methods have involved the use of heated fluids, but not in the manner contemplated by this invention. Prior art methods employ wells having two dimensional configurations such as those of U.S. Pat. No. 3,040,809, Pelzer, U.S. Pat. No. 3,983,939, Brown, et al., and U.S. Pat. No. 4,577,691, Huang, et al., having no lateral sweep component or radial wells as in U.S. Pat. No. 4,257,650, Allen, U.S. Pat. No. 4,265,485, Boxerman, et al., U.S. Pat. No. 4,410,216. Allen and Canadian Patent 1,072,442, Prior, which cannot attain a full field symmetry for a symmetrical sweep of the oil from the formation.

Prior methods also employ heated fluids to soften the oil in formation thereby causing it to flow into collection wells. However, such fluids are usually applied at only one level in the formation or one at a time in the manner of huff and puff wells. Furthermore, the prior art well designs do not allow the buildup of an energy cap oriented to the formation for a full sweep thereof by which the present invention achieves its improved yields.

These prior art methods, while marginally effective, are time consuming and inefficient, their maximum recovery rates being only about 30% of the oil present in the less viscous oil sands. For example, in the case of huff and puff wells, the heat level necessary to raise formation temperatures sufficiently often yields in situ distillation of the crude in the immediate vicinity of the arms, which results in the formation of heavy tar and paraffin deposits which clog the formation and prevent oil flow. Wells that employ flue gas with sufficient oxygen to support in situ combustion also suffer this problem. In the case of tar sands wherein the trapped oil is in the form of highly viscous bitumen, recovery has been only on the order of 1-5% using expensive and environmentally dirty methods of mining and washing. Because of this, the more viscous tar sands have been primarily used directly as bitumen paving material.

A further deficiency of radial wells is the continuously increasing distance between the arms as they extend outward. This makes efficient heat flooding of the formation and consequent oil recovery extremely difficult and renders such wells extremely susceptible to pressure breakthrough between the arms close to the main shaft. Such breakthrough disturbs the pressure symmetry across the field rendering an even sweep difficult, if not impossible. Single recovery wells surrounded by vertical injection bores suffer similarly since the heat or gas applied to the formation extends radially in all directions, not just toward the well bore.

Another problem with current methods of tar sand recovery is the heat produced. Waste heat and flue gas from processing the sands and coking the recovered oil is evacuated to the atmosphere contributing to chemical and thermal pollution. Alternatively, cooling facilities and gas scrubbers must be constructed on site in order to protect the environment.

The inventor herein has developed a method and apparatus that overcomes the deficiencies of the prior methods of oil and tar sand recovery permitting efficient and environmentally clean recovery of petroleum bound therein at levels heretofore unexpected and unobtainable by previous methods.

SUMMARY OF THE INVENTION

The present invention is an advanced, enhanced recovery technique for the production of crude oil reservoirs and bitumen from tar sands and other formations, heavy crude oil reservoirs and abandoned oil reservoirs which may still contain as much as 60% of their original reserve. Such reservoirs have historically been low yielding with regard to the crude oil, tar and bitumen they have given up to present day production methods.

The technique is centered around the use of steam and hot flue gases or super heated crude oil vapors and hot flue gases applied at different levels within the formation to liquify the oil and drive it out of the interstices. Toward this end, a vertical well is mined and upper and lower grids of bore holes extended outward therefrom in a specific pattern.

The technique of this invention raises the temperature of the reservoir with two hot fluids applied simultaneously, one at the crest of the oil bearing formation and the other at the base of the formation. Waste heat in the form of flue gas from the steam boiler or super heater is injected into the crest of the formation through the upper grid and the steam or super heated oil vapors are injected through the lower grid into the base of the formation. The hot flue gas scrubs the attic of the formation and forms a pressurized heat chest actually distilling a portion of the crude oil in situ. Gravity segregates this portion and creates a bank of fluid forcing it downward to the lower symmetrical grid. The bore holes of the lower grid alternate as heating and producing holes with the steam or super heated crude oil vapors which permeate the oil bearing formation, exchange the latent heat to the crude oil in situ as the vapors condense and are absorbed by or mix with the crude oil lowering its viscosity.

The liquid mixture of crude oil and condensed vapors, whether from steam or super heated crude, is collected in a main shaft gathering tank and pumped to the surface. A portion of the steam or oil vapor may be channeled through coils in the storage tank to keep the oil warm and flowable and can then be condensed and recycled. In the case of steam usage, the condensate from the lower grid that is mixed with oil is scrubbed in a separation facility to remove the oil, which then goes to a treatment facility, and the condensate is recycled through the boiler to reform as steam for reintroduction to the grid. By recycling the water in this manner, the volume required is kept to a minimum, only occasional make up volume is necessary to replace that lost through evaporation and harm to the environment is significantly reduced. Where super heated crude oil vapor is used, the condensate is completely miscible with the recovered crude thereby eliminating further treatment. A portion may be drawn off for super heating and introduction as vapor into the reservoir.

A further environmentally significant feature of the present invention involves the flue gas from the burners firing the boiler that is injected into the upper grid to push the oil downward. The formation acts as a filter for the gas, removing the need for separate $SO_2$ and $NO_x$ scrubbers. Expressed oil is recovered from the lower grid into a holding tank at the bottom of the well from where it is pumped to the surface. Associated hydrocarbon gasses are also recovered and piped to the boiler as additional burner fuel, or for use in producing the super heated vapors injected to the lower grid.

Most of the heat delivered to the lower grid remains in the rock of the oil bearing formation and moves upward via conduction. Eventually, the entire formation will be heated. As crude oil is removed from the formation by alternately injecting and producing the lower grid bore holes, additional crude oil is forced into the voided porosity of the formation as the flue gas heat chest expands from above. This process will eventually void the entire reservoir of crude oil leaving only flue gas and a small residue of oil on the rock. Depending on the stabilized temperature reached and the nature of the crude oil, recoveries will be in the range of 80% to 95% of the original oil in place.

Installations of this type also have electricity requirements for pumps, compressors, fans and the like. Accordingly, it is also an object to incorporate into the apparatus a generation plant driven by the steam produced from the boiler. Thus the steam, before it is sent to the lower grid, passes through the generating plant. This serves two purposes; first, the generation of electricity needed for the installation and the surrounding area, and second, the moderation of the steam temperature. Excessive heat is to be avoided to prevent in situ distillation of the crude oil which would result in heavy deposits that would clog the pores of the rock formation and restrict or prevent oil flow therefrom.

It is therefor an object to provide a method for the improved recovery of crude oil from oil and tar sand and other formations.

It is a further object to provide a method for such recovery that is energy efficient and environmentally safe.

It is a still further object to provide a method whereby recovery of oil from such formations is on the order of 50–95% of the trapped crude.

And it is a still further object to provide a low gravity, crude oil tertiary production system for efficient recovery of oil from oil and tar sands and other formations that is economically and energy efficient, conservative of water, environmentally safe and provides significant increases in yield over prior systems.

DETAILED DESCRIPTION OF THE INVENTION

Figure 1:
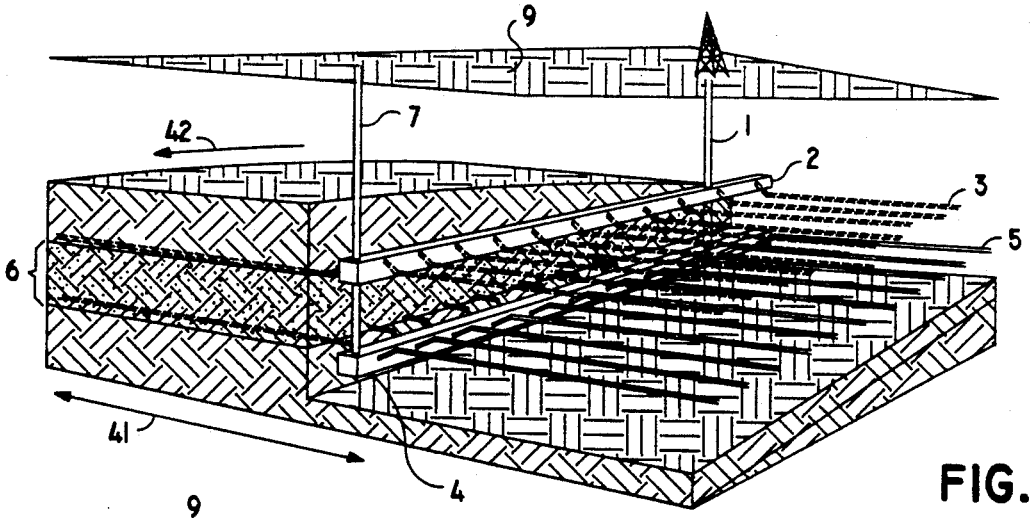
FIG. 1 is a horizontal perspective view of a prefered well configuration of the present invention illustrating the upper and lower grid configuration.

According to FIG. 1, the well is constructed in the following manner. A large diameter vertical main shaft 1 is mined and cased from the surface 9, through the oil bearing strata 6 at least to the bottom of the formation. Preferably shaft 1 extends approximately 50 feet below the strata 6. The casing may be a sprayed on material such as gunite. A second shaft 7 may be provided for emergency access and egress. Outward from opposite sides of the main shaft 1 and extending along the dip 42 of the strata 6 are mined two drifts 2, 4, an upper drift and a lower drift 4. Upper and lower bore holes 3, 5 extend in a plane parallel to the strike 90 degrees on either side of their respective drifts 2, 4 to form upper and lower grids each with a rectangular arrangement. The distance separating the upper and lower grids will depend on the permeability of the rock and may be the entire thickness of the deposit or any distance between the upper and lower limits thereof. However, all distances are included herein and 10 feet between the upper and lower grids is considered to be the minimum necessary. Where the tar sand deposit thickness and permeability dictate, the deposit will be tapped in stages from top to bottom in increments, the thickness of those increments will be dependent on the permeability of the rock. In such a case, a first set of grids will be mined and drilled and the oil extracted from the intervening formation. When this level has tapped out, another grid will be mined and drilled below the first lower grid. This will form the lower grid of the second level while the first lower grid will become the upper grid of the second level. This procedure will be continued over time to the bottom of the formation.

Where the dimensions and permeability of the oil bearing strata 6 permit, only one set of upper 2 and lower 4 drifts with their associated bore holes 3 and 5 need be mined and drilled. In such instances the upper drift 2 will preferably be mined above the strata 6 and along its dip 42 with the bore holes 3 drilled downward therefrom into the strata 6 and horizontally relative to the drift 2 along the strike 41 of strata 6. The bore holes 3 will normally be drilled on either side of drift 2 and will be parallel and equidistant to one another.

Lower drift 4 will preferably be mined below the oil bearing strata 6 along the dip 42 and parallel to upper drift 2. Bore holes 5 will be drilled upwardly into the strata 6 then horizontally along the strike 41. As with upper bore holes 3, lower bore holes 5 will normally extend from either side of drift 4 and be parallel and equidistant to one another.

Each of the drifts 2, 4 is cased like the main shaft while the bore holes 3, 5 are preferably open and uncased to allow for inflow of the flue gas and heat and outflow of the oil. By leaving the bore holes uncased, their full length is open to the formation for injection of heat and flue gas and removal of oil. In some formations, such as unconsolodated conglomerates, it may be necessary to case the bore holes 3,5. In such instances a casing of sand screen or mesh is preferred to maintain their open nature.

Figure 2:
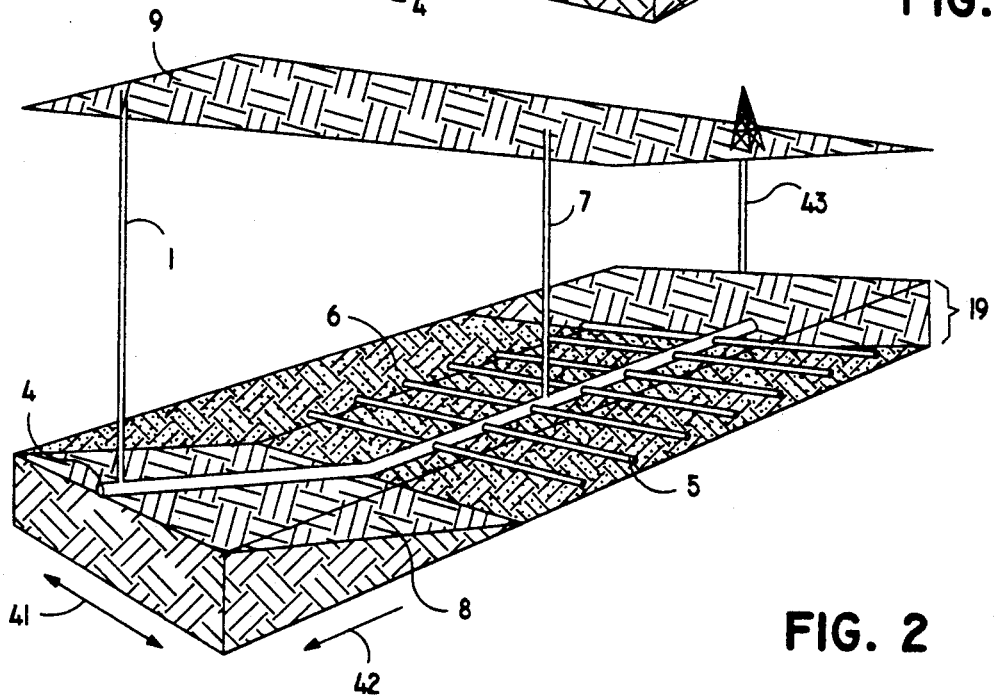
FIG. 2 is a horizontal perspective view of an alternative well employed with the method of the present invention.

FIG. 2 illustrates a well configuration for use in a formation having a relatively thin oil bearing strata 6 with a steep dip 42, or angle relative to the surface. In such a formation the main shaft 1 is mined downward at the lower end of the strata 6 and a single drift 4 is mined up the dip 42 under the strata 6 until it reaches the upper end. As with the standard configuration of FIG. 1, bore holes 5 are drilled outward from the drift 4 into the strata 6 along the strike 41. Where the dip 42 is steep enough, only one grid of drift 4 and bore holes 5 will be needed as the bore holes will serve for both injection of flue gas and steam or superheated crude oil vapor and production holes in a manner to be described later. A second shaft 7 may also be provided along the drifts 2, connecting them to the surface for emergency access and egress.

Figure 3:
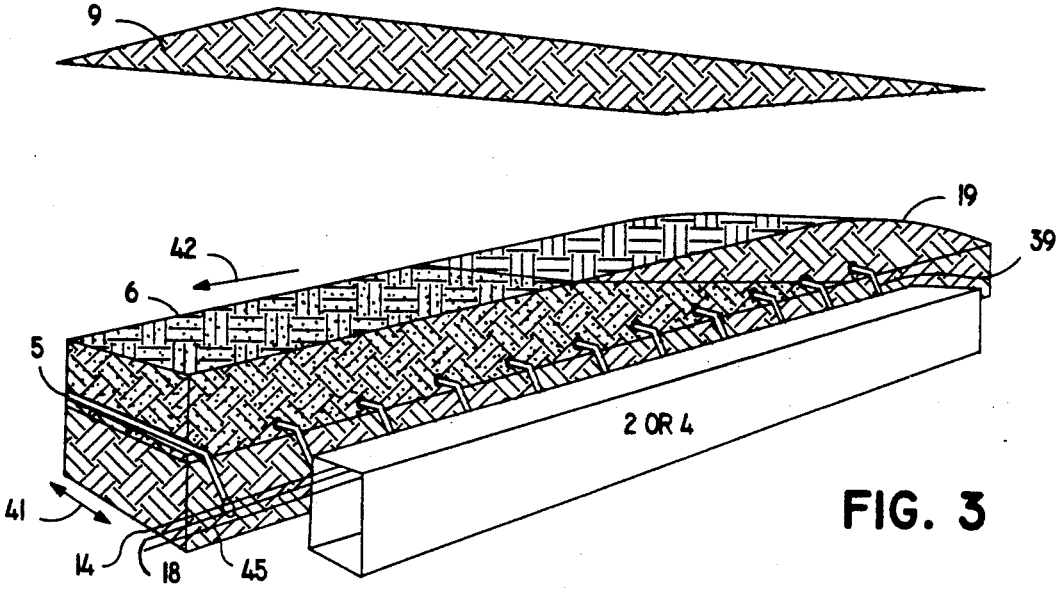
FIG. 3 illustrates a lower drift and bore hole relationship of the well of FIG. 1.

FIG. 3 illustrates a drift and bore hole relationship; in this instance lower drift 4 and one set of bore holes 5. Steam or super heated crude oil vapor header 14, production header 18 and flue gas injection header 45 are shown extending along drift 4.

Figure 4:
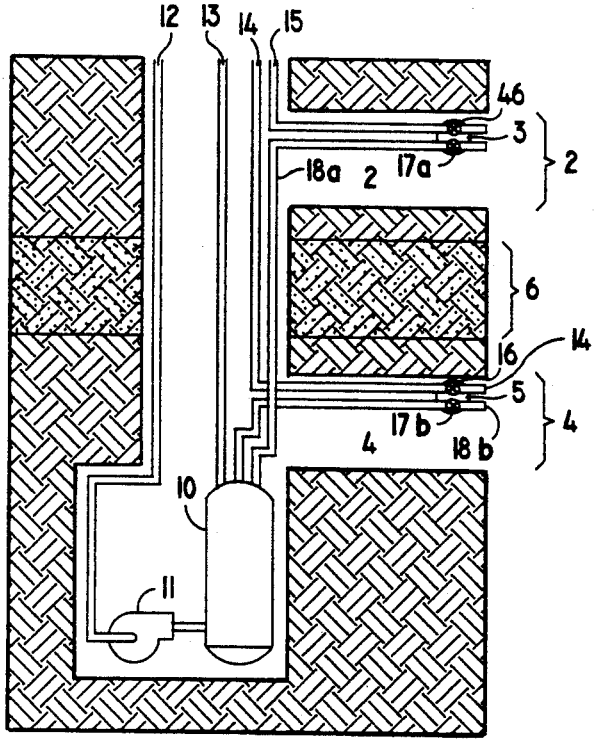
FIG. 4 is a vertical cross section of a well emplacement according to the present invention illustrating the down hole elements and piping of the well.

In FIG. 4, the down hole elements associated with main shaft 1, upper drift 2 and lower drift 4 are shown. At the bottom of main shaft 1 is located crude oil gathering tank 10, production pump 11 and production piping 12 connecting to the surface. In addition, an insulated hot flue gas header 15 connects to valves 46 in all of the upper bore holes 3, a first production header 18*a* connects to valves 17*a* in the upper bore holes 3 and a second production header 18*b* connects to valves 17*b* in the lower bore holes 5 of lower drift 4. Both production headers 18*a* and 18*b* empty into crude oil gathering tank 10 from which also extends a produced gas vent line 13 connecting the tank 10 to a vapor recovery system 38 which is preferably part of the surface equipment shown in FIG. 7. Insulated header 14 conveys steam or superheated crude oil vapors from the surface equipment to valve 16 at each of the lower bore holes 5 in lower drift 4. It is preferred that all valves 16, 17*a*, 17*b* and 46 will be automated or remotely actuatable.

Figure 5:
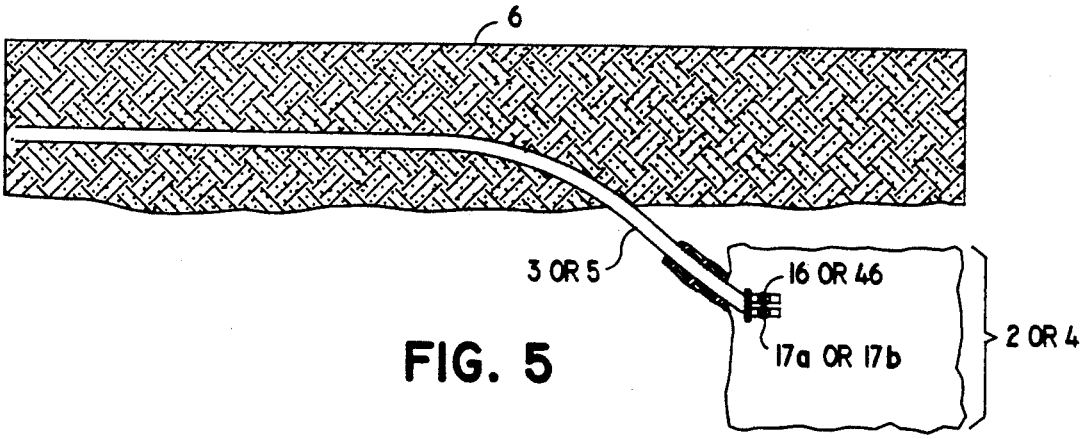
FIG. 5 is a horizontal representation of a typical drift of the well of the present invention.
Figure 6:
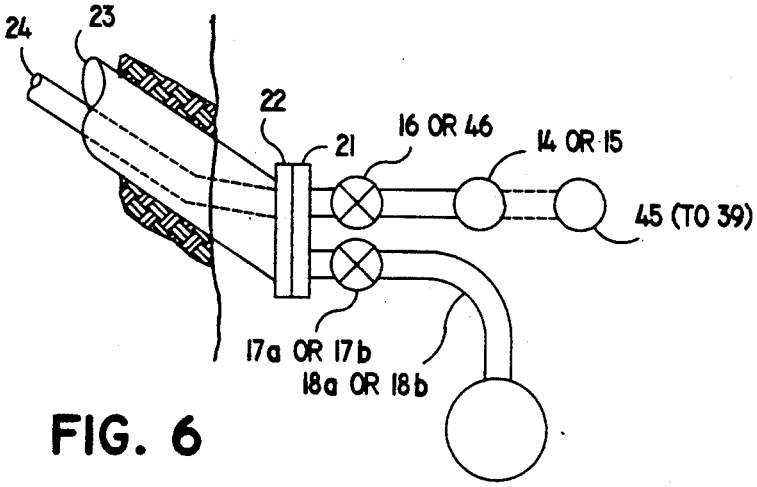
FIG. 6 illustrates the detail of connection between bore holes and drifts of the well configuration of the present invention.

Referring to FIGS. 5 and 6, the relationship between the bore holes 3, 5 and their respective flue gas and steam or superheated crude oil vapor lines 14 and 15 together with the production lines 18*a* and 18*b* can be seen. Each bore hole 3 and 5 is drilled substantially horizontally from its respective drifts 2, 4 the connection thereto being through a header comprising a grouted flange 22 and a matching valve assembly flange 21. Bore holes 3, 5 may include a grouted conductor pipe 23 extending from the flanges 21, 22 into the bore hole 3, 5. As shown in FIGS. 5 and 6 the bore holes 5 of the lower grid may be drilled at a slight upward angle relative to the horizontal to assist in the flow of oil and condensate therefrom. Such an upward angle will have no adverse effect on the subsequent use of lower grid bore holes as an upper grid in formations that are tapped in sequential layers.

The flue gas and steam or super heated vapor lines 15, 14 connect to the bore holes 3, 5 through their respective valves 46 and 16 associated with valve flange 21. The flanges 21 have additional valves 17*a* and 17*b* below the valves 16 or 46 for outflow of oil and condensate. These outflow valves 17*a* and 17*b* connect to production lines 18*a* and 18*b* in the drifts that flow to storage tank 10 at the bottom of main shaft 1.

Both the flue gas pipe and the steam or superheated vapor pipe, represented by pipe 24 in FIG. 6, are perforated along their lengths, valves 16 or 46 at their inner ends allow for control of flow therein dependent on the stage of injection or production. The valves may be controlled from the surface and their inclusion at each bore hole permits greater control of heat and pressure levels in the well. The flue gas pipe is preferably rated for 50–100 PSI while the steam and super heated vapor pipe may have a lower rating on the order of 10–50 PSI, but may also be of a higher rating when necessary, such as 150 PSI. When necessary, support members for the respective pipes may be included and it is preferred that these pipes be constructed in sections to facilitate insertion and removal.

FIGS. 5 and 6 illustrate the relationship between the drifts 2 and 4 and bore holes 3 and 5 and is equally applicable to the comparable portions of both upper and lower grids. The main lines for flue gas, steam, super heated vapor and oil production may feed all or part of the bore hole pipes in a particular grid and connect to the fluid sources at the surface or the collection tank 10 depending on whether it is feeding an upper grid or a lower grid or producing oil. If necessary, a plurality of main lines may be employed, each feeding a portion of the grid and each controlled by separate valves. Thermal sensing devices may be inserted into the formation between the bore holes for measuring the temperature of the formation, this data being used to regulate heat flow. Other sensors may be included at various points within the steam and flue gas lines to monitor temperatures and pressure for control purposes. The arrangement of the bore holes 3, 5 extending from each drift 2, 4 may be regular, or alternating.

At the bottom of the main shaft 1 is storage tank 10 into which the recovered oil flows from the grids through conduits 18*a* and 18*b* and which may include a heat exchange coil. A portion of the steam or super heated vapor supplied to the lower grid is preferably drawn off from conduits 15 or 14 to pass through this heat exchange coil which is submerged in the crude oil in tank 10. In the coil the steam or vapor condenses giving off heat to the surrounding oil to keep it fluid. The resulting condensate is then pumped to the surface for re-use. If superheated crude oil vapor is used instead of steam, it may be injected into the oil collected in tank 10, it being completely miscible therewith. When oil in tank 10 includes water from steam that has condensed in the bore holes 5 and flushed the oil into the tank 10, this oil/water combination is sent to the surface by pump 11 where it is separated, with the water being recycled in the system and the oil treated by coking, refining or the like. In the case of any pumps used, it is preferred that there be back-ups for use in the event of failure of the primary unit. Finally, conduit 13 conveys evolved hydrocarbon gases to the surface. These gases may be stored or directed to the generation or oil treatment plant as additional fuel. A compressor is placed in the hydrocarbon gas line 13 to drive hydrocarbon gases to the surface and to maintain a constant reduced pressure on tank 10 which in turn maintains a reduced pressure on the producing bore holes.

Figure 7:
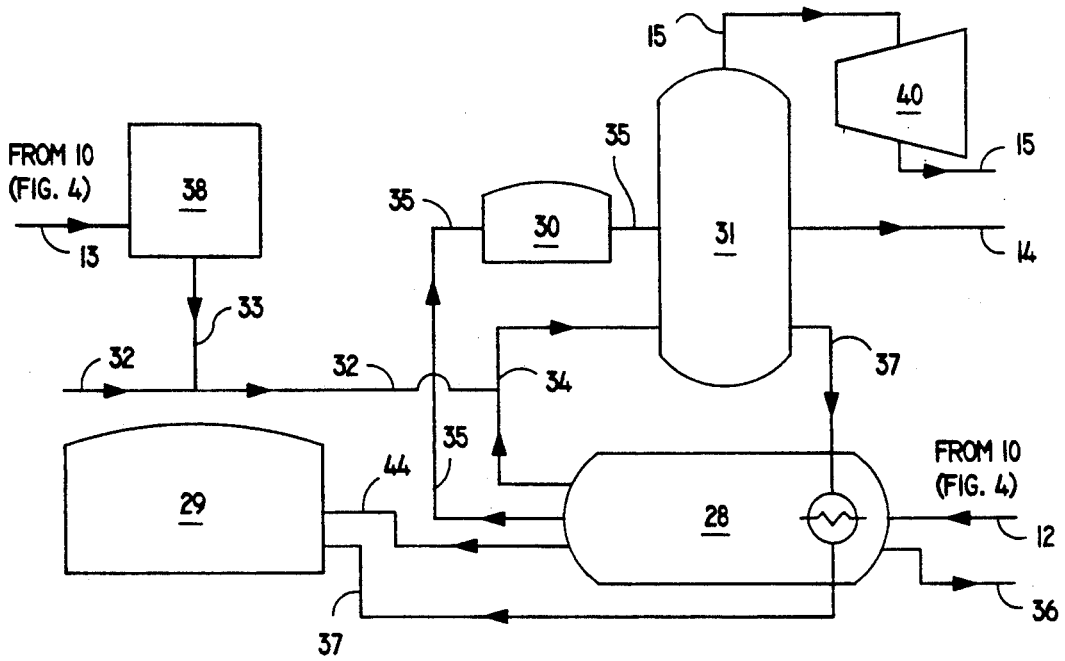
FIG. 7 is a schematic representation of the surface equipment configuration employed with the well of the present invention.

FIG. 7 illustrates a surface equipment configuration for use with the well configuration as described and in the method employing super heated crude oil vapor as the lower grid heat source. In this configuration crude oil delivered from the crude oil gathering tank 10 through pump 11 and discharge line 12 is treated at a three-phase gas-oil-water separator 28. Waste water 36 may be sent to a disposal well or, when required, used for steam production. A portion of the crude oil 44 will go to storage 29 for eventual sale and a portion 35 will be sent to the crude oil super-heater feed storage 30. Separated gas 34 will be sent to the super heater 31 fuel gas supply. Crude oil delivered to super heater storage 30 will be automatically transferred to the crude oil super-heater 31 as required. As the crude oil is distilled and the vapors become super-heated, they will reach a preset pressure which will allow them to exit the super heater 31 through an appropriate valve. As the super heated vapors leave the super heater 31 by of way of insulated header 14, additional crude oil feed will be delivered to super heater 31. The undistilled heavy ends of the crude will be continuously drawn off from super heater 31 and returned to storage 29 via return line 37. Preferably, this automatic drawing off of the heavy ends will be accomplished using a "head" switch which monitors the specific gravity of the fluid in super heater 31. This hot undistilled crude will serve as a heat source for three phase separator 28 by passing through a heat exchanger within separator 28 on its way to storage 29. Preferably, super heater 31 will operate at temperatures up to 650° F. and pressures up to 150 pounds per square inch. A portion of the flue gas from super heater 31 will be sent to a compressor 40 and then delivered to insulated header 15 for injection into the oil bearing strata 6 via bore holes 3. Vapor recovery system 38 will receive gases by way of vent line 13 from crude oil tank 10 and will deliver those gases through pipe 33 to super heater fuel supply 32.

Figure 10:
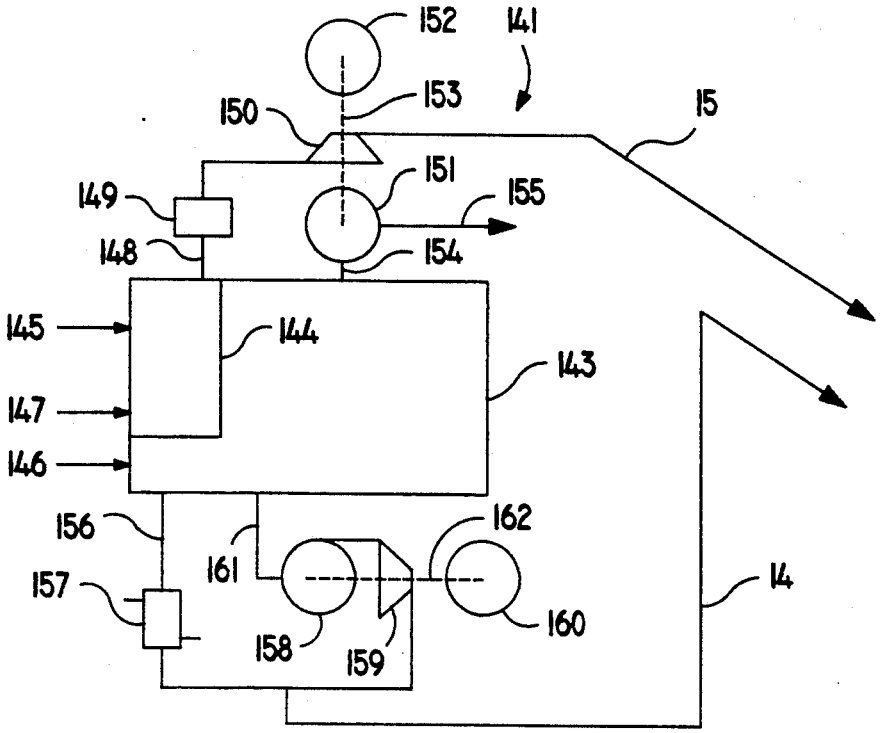
FIG. 10 is a schematic representation of a generation and heating plant employed in conjunction with the well.
Figure 11:
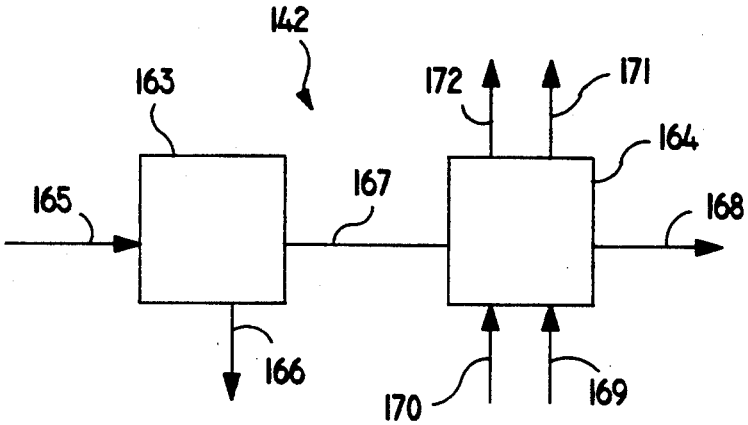
FIG. 11 is a schematic representation of an oil/water separation and oil treatment facility employed with the generation and heating plant and the well.

Alternative surface installations are illustrated in FIGS. 10 and 11 and comprise a steam generation plant 141 and an oil/water separation and oil treatment facility 142, respectively.

The steam generation plant 141 comprises a boiler 143 fired by coal, oil, gas or other, preferably local fuel. In the case of the Utah locations, compliance or low sulphur coal is readily available. Also, recovered gas from line 13 may be used as fuel. The primary fuel enters the burners 144 for the boiler 143 at 145 with water supplied to the boiler 143 at 146. Secondary fuel such as hydrocarbon gas recovered from the well through conduit 13, may be fed to the burner 144 at 147. The water fed to the boiler 143 will initially be new water to get the system started. However, once it is operational, most of the water fed in through 146 will be recycled condensate from the storage tank heat exchange coil and water recovered from the oil/water condensate mixture in the separator portion 163 of the separation/treatment facility 142.

Hot flue gas from the burner 144 exits through a flue 148 and may pass through a preliminary particulate separator 149 before entering a compressor 150. Hot pressurized gas exits the compressor 150 and is sent to the upper grid bore holes 3 via conduit 15. The compressor 150 may be electrically powered or, and more preferably, may be powered from a steam turbine 151 which also drives a generator 152 on a common axle 153. The steam turbine 151 itself is powered by steam produced in the boiler 143 and directed to the turbine 151 through line 154.

After performing work in the turbine, the steam or waste heat is then sent to the lower grid bore holes 5 of the well or to recovered oil storage through line 155 which may connect with the main steam line 14 in the main shaft 1.

The main portion of the steam produced in the boiler 143 exits through line 156 into a heat balancing system which may comprise a heat exchanger 157. In this manner the correct heat level going to the lower grid bore holes 5 may be maintained to prevent in situ distillation of the crude. After passing through the heat balancing system, the steam is sent to the lower grid bore holes 5 through the main line 14. Additional heat and steam may be added from a generator system comprising a turbine 158, compressor 159 and generator 160. In this system, steam from the boiler 143 enters turbine 158 through line 161. The turbine drives compressor 159 and generator 160 on a common axle 162. Steam and waste heat exiting the turbine 158 are pressurized in compressor 159 and added to steam flow in main line 14 or sent to oil storage as above to keep recovered oil fluid. Electricity produced by generators 152 and 160 is used to power equipment on site or is supplied to the local electrical grid.

The oil/water separation and oil treatment facility 142 shown in FIG. 11 is connected to the entire system between the well and the steam generation plant 141. This facility comprises a separation means 163 and an oil treatment means 164. The separation means 163 may be any process or apparatus that physically separates oil and water within a confined facility thereby allowing for recovery and subsequent re-use of the water. The oil/water combination retrieved from the well through conduit 13 enters the separator 163 at 165. Water removed from the oil exits at 166 and is fed to the boiler 143 by a connecting line to 146. Separated oil goes to a treatment means 164 through connecting line 167 for refining, coking, etc., the final product being retrieved at 168. The oil treatment means may be fueled through line 169 by any appropriate fuel, including recovered hydrocarbon gas from the well, or, if only heat energy is needed, it may be taken from the cogeneration plant and fed in through line 170. Any hot flue gas generated by this facility is taken from line 171 and is added to that from the cogeneration plant 141 in line 15 for injection into the upper grid bore holes 3, while waste heat from line 172 is added to the steam/heat line 14 either directly or through heat exchanger such as 157, for delivery to the lower grid bore holes 5 or to line 155 for delivery to oil storage.

Clearly, any excess heat and hydrocarbon fuel gas beyond that needed by the system can be used to provide heat and fuel for the rest of the facility including living quarters, maintenance buildings and the like. Also, waste heat from the turbines and other heat generators is used in heat tracing lines that parallel oil and steam lines in the system and production facilities. In addition, excess hydrocarbon fuel gas may be purified and shipped off site as a product of the well.

While the physical size of the well structure may be variable depending on conditions at the site, it is preferred that the main shaft 1 be on the order of 10 feet in diameter and the drifts 2, 4 have a 7 to 8 foot diameter. A combination elevator and lifting mechanism is includable to provide access and for placement and recovery of equipment. The bore holes 3, 5 need only be of small diameter sufficient to accommodate flue gas and steam pipes as described and allow for the flow of oil. Four to six inch diameter bore holes 3, 5 with two inch steam and flue gas pipes are preferred with the main line pipes 14, 15 and 18 in the drifts 2, 4 being 4–8 inch, non-perforated, thermally wrapped pipe stock rated for the necessary pressures. Spacing of the bore holes 3, 5 again depends on the condition of the formation, notably its permeability, but will preferably be 100 to 1,000 feet. When present, the thermal sensing devices will be located mid-way between the bore holes.

In some locations, tar sands have an exposed, substantially vertical face and run back into an outcropping in a manner similar to a coal seam. Where these types of formations occur and present a face that is totally above ground, the vertical shaft may be omitted. Instead, the exposed face may be sealed, as with gunite, and the grids mined and drilled directly into the formation. A recovery tank will be located at the base of the vertical face, while the treatment and generation facility may be also at the base or located on the surface over the formation.

The oil recovery technique of this invention raises the temperature of the oil in formation with two hot fluids applied simultaneously at the crest and the base of the oil bearing strata. Waste heat in the form of flue gas from the super heater or steam boiler is injected into the crest of the formation while super heated crude oil vapor or steam is injected into the lower horizontal symmetrical grid. The hot flue gas scrubs the attic of the formation and forms a pressurized heat chest which actually distills a portion of the crude oil, segregates it by gravity and creates a bank of fluid forcing the oil downward to the lower symmetrical grid.

The initial injection of hot flue gas into the upper bore holes 3 will result in an initial production of oil from the upper bore holes 3 through valve **17*a* into production line 18*a*. This initial production can be recovered and processed through either the super heater assembly of FIG. 7 or the separator and steam generation facility of FIGS. 10 and 11 for the generation of super heated crude oil vapors or steam which are injected into lower bore holes 5** to initiate full production.

Figure 8:
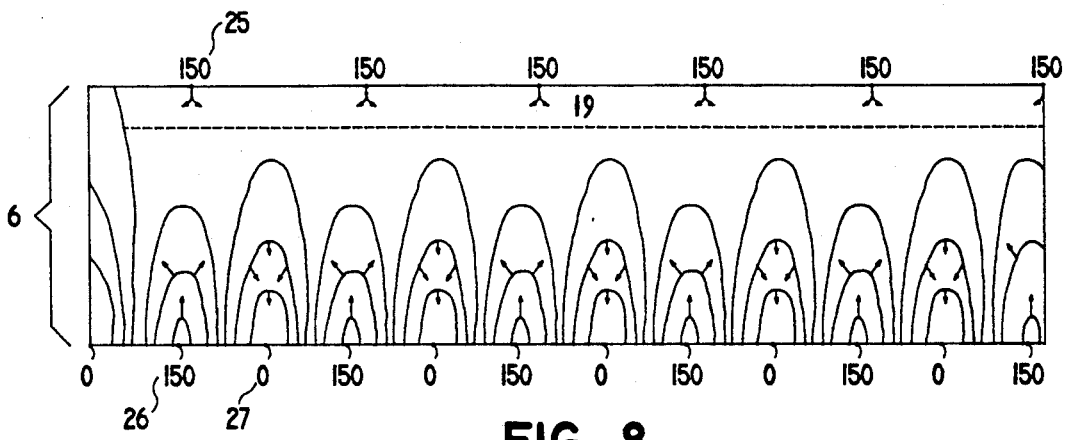
FIG. 8 is an isobaric cross section of a formation under production by the method and well configuration of the present invention.
Figure 9:
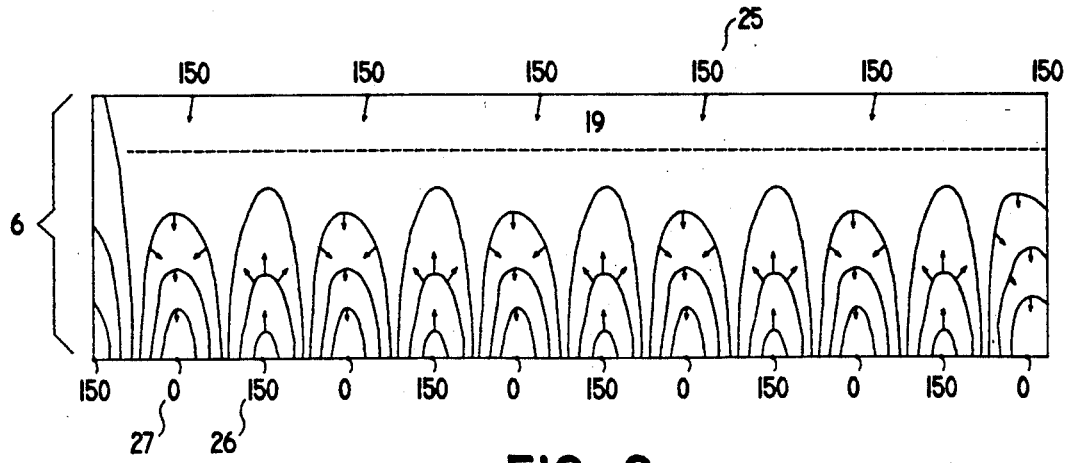
FIG. 9 is an isobaric cross section or a formation under production as in FIG. 8 with the injection and production bore holes reversed.

The lower grid bore holes 5 are alternately heated and produced as shown in FIGS. 8 and 9 by the steam or super heated crude oil vapors. These hot fluids permeate the oil bearing strata, exchange latent heat to the crude oil and are either absorbed by the in situ crude oil, in the case of the super heated vapors thereby lowering the viscosity through heat and miscibility, or flush the softened crude out of formation in the case of the condensed steam.

The liquid mixture of crude oil and condensed vapors or steam is gathered in the crude oil gathering tank 10 in main shaft 1 from which it is sent to separation and super heating or storage. Most of the heat delivered to the lower grid remains in the rock of the oil bearing strata and migrates upward by conduction as the flue gas cap pushes downward to eventually heat the entire formation. The expanding heat chest forces additional crude from the upper portion of the strata into the voided and heated porosity of the lower strata thus flushing the entire formation. The rectangular symmetry of the grid structure provides the most effective sweep possible and keeps the operating pressures substantially evenly distributed across the field. This, coupled with the low operating pressures necessary in this system allow a high rate of production with a significantly reduced tendency toward a premature break through of the injected fluids.

Referring to FIGS. 8 and 9, the isobaric cross section of a producing field is shown as the lower grid bore holes 5 are alternated between injection and production. In FIG. 8 flue gas injection 25 is delivered to the gas cap 19 through upper grid bore holes 3. Lower grid bore holes 5 alternate between injection of super heated crude oil vapors or steam 26 and production of oil 27. Due to the pressure difference between the injection bore holes 26 and the production bore holes 27, pressure sinks are produced between the injection holes 26 causing oil to be drawn out through the production holes 27. This action is further assisted by keeping a slightly reduced pressure in oil gathering tank 10. The cross section of FIG. 9 has the same configuration as that of FIG. 8 except that the injection 26 and production 27 bore holes have been reversed. Such alternating reversal of injection and production holes in the lower grid tends to produce a pumping action which further helps to draw the crude oil out of the formation.

In the case of the steeply sloping formation depicted in FIG. 2 where only one grid is used, the gas cap is formed at the upper end of the formation by first injecting flue gas through the up dip bore holes at that end of the field. Production can be conducted sequentially down the dip of the field by changing bore holes from production to gas injection as the gas cap progresses, or, if the size of the field permits, the up dip bore holes may be used for gas cap injection and the down dip holes for oil production.

The method wherein super heated crude oil vapors are applied to the lower grid is preferred over the use of steam particularly in arid or semi-arid regions as it reduces or eliminates the need for water in the system. Ground water produced with the oil and separated therefrom can be returned to the ground or used in other processes. Where the steam method is used, again ground water produced with the oil is recyclable in the system which reduces the outside water requirement and eliminates the problem of waste water disposal. The use of super heated crude oil vapors is also preferred in view of the miscibility of such vapors with the in situ oil and the reduced requirements for outside raw materials or fuel.

Of the heat energy produced by the steam generation plant or the super heater facility, 100% is utilized in the system to either generate electricity or produce crude oil. The energy breakdown related to use is: 40–60% of the heat energy as steam used to produce electricity, 20–30% as steam or super heated vapor to heat the lower grid, and 20–30% as hot pressurized flue gas injected into the formation through the upper grid. Because of this total usage with all the combustion products and heat energy being injected into the formation or used to keep stored oil fluid and steam water being recycled, the environmental problems normally associated with the burning of fossil fuels and oil recovery from tar sands are avoided. Produced gases, particularly $SO_2$ and $NO_x$, are filtered by the reservoir rock as they move through the formation, all heat is transferred to the formation and the oil therein, or used elsewhere in the facility, instead of wasted to the atmosphere, and any hydrocarbon gases generated are captured and used as fuel or processed for other use.

It is noted that circumstances may arise wherein additional or alternative pressurized fluids may, of necessity, be applied to the upper grid, fluids such as natural gas or even compressed air. In such circumstances, it is considered to be within the teaching of this invention to include such additional or alternative fluids. Similarly, whereas it is anticipated that the steam or super heated vapors and flue gas will provide sufficient heat for the extraction of oil from the formations, at times it may become necessary to increase the boiling point of the water used to generate steam applied to the lower grid. This would be more likely in the case of the high viscosity, bituminous tar sands. In such instances additives, such as ethylene glycol and the like, having the effect of raising the boiling point of water, and thereby the temperature of the steam, may be added to the boiler water.

Tests indicate that tar sand deposits, such as those in Utah, hold an average of 1500 Bbl/acre foot of formation, the range being 1100–1800 Bbl/acre foot. Therefore, given a single 40 acre tract at 200 foot thickness, the amount of oil in such a section equals approximately $12\times10^6$ Bbl. Oil recovery using the well system and method of this invention is estimated to be 50–80% or $6\times10^6$ Bbl to $9.6\times10^6$ Bbl at a rate of 5,000–35,000 Bbl/day for each 40 acre abstract. Actual amounts of oil present in the formation and recoverable depend on the geological structure and porosity of the rock. Carrying the above figures on to a full 160 acre tract where the main shaft 1 has two sets of drifts extending in opposite directions among the dip 42 and where each drift serves two 40 acre sections, a single well thereby covering 160 acres, the yield is $24.0\times10^6$ Bbl to $38.4\times10^6$ Bbl. Applying these calculations to the broader range, the recovery capable with this system is $4.4\times10^6$ to $11.5\times10^6$ Bbl from a 40 acre tract, a full 160 acre system delivering $17.6\times10^6$ to $46.0\times10^6$ Bbl. With thicker deposits, the yield will clearly be even greater. As shown in the following example, preliminary tests on samples from the White Rocks area of Utah indicate that the system of this invention will produce yields of at least 50% and possibly as high as 90% of the oil in formation, far in excess the 1–30% recovery rates encountered with prior methods.

EXAMPLE 1

Samples of tar sand native to Duchesne County, Utah were obtained and tested by TerraTek Geoscience Services of Salt Lake City, Utah under routine core analysis. The samples tested were plugs taken from two blocks of tar sand outcrop material.

Residual water was removed and measured by means of the solvent distillation extraction technique using toluene. Remaining tar was removed by flushing with chloroform/methanol azeotrope. Porosities were determined by measuring grain volumes in a helium expansion porosimeter using Boyle's Law and bulk volumes in mercury using Archimedess' principle. Permeabilities to nitrogen gas were measured in a Hassler sleeve using an orifice-equipped pressure transducer to monitor downstream flow. The analysis results are presented in Table-1.

TABLE 1

| | | Preliminary Sample Analysis | | | |
|---|---|---|---|---|---|
| Sample No. | Block No. | Porosity % | Oil saturation % | Water saturation % | Permeability md |
| 1 | 1 | 23.6 | 74.3 | 7.6 | 1169 |

TABLE 1-continued

| Sample No. | Block No. | Porosity % | Oil saturation % | Water saturation % | Permeability md |
|---|---|---|---|---|---|
| | | Preliminary Sample Analysis | | | |
| 2 | 1 | 23.4 | 75.4 | 7.0 | 2370 |
| 3 | 2 | 23.3 | 64.9 | 15.2 | 2184 |
| 4 | 2 | 23.0 | 71.9 | 11.2 | 4045 |

NOTE: Samples 2 and 4 were jacketed in lead sleeve.

Following the preliminary analysis above, a fifth sample, taken from Block No. 2, was tested using an experimental setup to duplicate the method of this invention as it would be applied in the field.

A two inch diameter sample was pressed into an elastomeric sleeve and clamped in place to ensure that gas would not bypass the sand. Steel end caps closed the ends with the upper cap having fittings for pressurization and the lower cap having ports for oil to run out through and to allow insertion of a thermocouple. The sample thus prepared was supported inside a length of six inch diameter steel pipe on top of the heat exchanger of a coal fired forced air furnace. The heat exchanger temperature was in the range of 800°-900° F. resulting in a core temperature of 150°-300° F., heat transfer taking place by convection.

As a pressuring gas introduced at the top of the sample, nitrogen was used. This was preheated by passing a six foot section of the delivery tube through the furnace flue. The test data of core temperature, nitrogen flow rate and pressure is summarized in Table-2.

TABLE 2

| Time | Core Temp. °F. | Flow rate CFH | Pressure PSI |
|---|---|---|---|
| | Test Data | | |
| 8:15 | 175 | 4 | 20 |
| 8:28 | 186 | 5 | 20 |
| 8:30 | 193 | 6 | 21 |
| 9:00 | 205 | 7 | 21 |
| 9:45 | 212 | 9 | 21 |
| 10:15 | 229 | 10 | 21 |
| 10:30 | 228 | 10.5 | 21 |
| 10:45 | 233 | 11 | 21 |
| 11:15 | 241 | 11 | 21 |
| 12:00 | 264 | 13.5 | 23 |
| 12:16 | 260 | 15 | 23 |
| 12:45 | 266 | 16 | 24 |

The increasing gas flow rate as a function of time indicates that the oil and water are being pushed out providing more paths for gas flow through the sand.

Following this treatment, the sample was provided to TerraTek for routine analysis as described above. Table-3 summarizes this analysis.

TABLE 3

| Sample No. | Block No. | Porosity % | Oil saturation % | Water saturation % | Permeability md |
|---|---|---|---|---|---|
| | | Analysis After Extraction | | | |
| 5 | 2 | 23.0 | 35.6 | 30.8 | 1479 |

Comparing the analysis of Table-3 with extraction analysis results in Table-1, it is shown that the method of the invention succeeded in extracting 50% of the oil contained by the sample in only 4½ hours at low pressure and the relatively low temperature obtainable with steam and flue gas.

Thus recovery is achieved at lower pressures and with more efficient energy usage and less pollution than any other system. Since tar sand deposits are usually shallow there is insufficient formation pressure to force the oil out. For in situ separation of the oil from the formation, pressure must be added to force the oil out of the rock. In conventional wells that employ just flue gas, these pressures can be quite high in order to get the relatively thick crude to flow. Huff and puff type wells require similarly high pressures to ensure sufficient flow as the formation cools and loses pressure. In addition, the prior art radial wells and single bore wells have inefficient drainage geometries which contribute to their low recovery figures.

In contrast, the present method obtains increased recovery at lower pressures. This is in part through the use of the upper and lower rectangular grids for the application of hot flue gas and steam heat or super heated crude oil vapors which results in a more even distribution of the heat and gas pressures within the formation and which provides a greatly improved and more efficient drainage geometry. Additionally, the low pressure in the lower grid results in a heating of the formation without a buildup of pressure that would restrict oil flow, thereby further reducing the gas pressure necessary. Similarly, by applying the heat and the gas pressure at the same time but from different levels, i.e., heat from below and heat and gas pressure from above, initial flow begins sooner and overall recovery is greater due to early and more even heating of the formation. Where heat and pressure are applied simultaneously from an outer zone inward toward the recovery well, the entire formation must be heated before flow begins. Furthermore, while the heat line progresses, the already heated portion of the formation continues to acquire heat with the risk of in situ distillation and the resulting formation of thick deposits that clog the pores of the rock and reduce oil flow. The present method reduces this risk by dividing the heating of the formation from the recovery zone upward and from the pressure zone downward so that the oil and the rock are more evenly heated and the oil flows out of the rock before it gets too hot. The hot flue gas injected into the tar sand from above adds to the formation pressure as well as the even temperature and to the force of gravity to increase the flow, the relatively low added pressure, 50-100 PSI, being sufficient in combination with gravity and even the low inherent pressure of the formation to force the softened or liquified oil out. Even though relatively low, the flue gas pressure should be greater than the prevailing pressure in the reservoir or formation. The effective pressure within the formation may be increased by maintaining the storage tank 10 at a reduced pressure.

Tests indicate that pressures within tar sand formations are generally from 25-60 PSI. Thus by adding 50-100 PSI of flue gas, the effective pressure on the oil in the formation will be 75-160 PSI. With the oil heated from above and below to its flowing temperature, such pressures are sufficient for continued flow of oil out of the rock into the recovery well.

The temperature range for heating the formation is preferably as low as is necessary to produce oil flow and will normally range between 100°-650° F. above the ambient formation temperature. In the case of heavy formations, the higher range of temperatures, up to a temperature just below the coking temperature of the particular crude being recovered would be preferable, whereas lighter crudes may be produced with a lower temperature.

EXAMPLE 2

In addition, computer modeling was conducted to compare the theoretical production of a conventional vertical radial well and the well of the present invention using the process described. Exhibit A is tabulation of the results of a computer model of what is referred to as "RADIAL FLOW".

EXHIBIT A
RADIAL FLOW MODEL
DRAINAGE AREA: 640 Acres, 50 Ft. Thick
DRAINAGE PATTERN: 10 Acre spacing
NO. OF VERTICAL WELLS: 64
Radial Flow Equation:
BOPD = [0.00708 * k * kor * L * d.P]/(vo * Bo * In(re/Dw/2) [From Calhoun, "Fundamentals of Reservoir Engineering," Section 30, "Darcy's Law-Radial Flow"]

L = 50 ft, borehole length
Dw = 0.5 ft, borehole diameter
d.P = 150 psi, differential pressure
k = (variable) md, permeability to air
kor = 0.6 relative permeability to oil
vo = (variable) cp, viscosity of crude oil
Bo = 1.0 formation volume factor
re = 330 ft, drainage radius - each vertical well
B.H. = 64 No. of boreholes (wells) for 640 Acres

| Est. Fm Temp Tfm deg F. | k = Visc in Fm cp | 50 BOPD from 64 B. holes | 100 BOPD from 64 B. holes | 200 BOPD from 64 B. holes | 400 BOPD from 64 B. holes | 600 BOPD from 64 B. holes | 800 BOPD from 64 B. holes | 1000 BOPD from 64 B. holes |
|---|---|---|---|---|---|---|---|---|
| 70 | 25317.0 | 1 | 1 | 3 | 6 | 8 | 11 | 14 |
| 100 | 808.7 | 22 | 43 | 87 | 174 | 261 | 348 | 435 |
| 125 | 174.2 | 101 | 202 | 404 | 807 | 1211 | 1615 | 2018 |
| 150 | 64.3 | 273 | 547 | 1094 | 2188 | 3281 | 4375 | 5469 |
| 175 | 31.9 | 551 | 1103 | 2205 | 4411 | 6616 | 8822 | 11027 |
| 200 | 18.9 | 930 | 1861 | 3721 | 7443 | 11164 | 14885 | 18606 |
| 225 | 12.6 | 1399 | 2798 | 5595 | 11190 | 16785 | 22380 | 27976 |
| 250 | 9.0 | 1944 | 3888 | 7775 | 15550 | 23326 | 31101 | 38876 |
| 275 | 6.9 | 2553 | 5107 | 10214 | 20428 | 30642 | 40856 | 51070 |
| 300 | 5.5 | 3218 | 6435 | 12871 | 25741 | 38612 | 51482 | 64353 |
| 325 | 4.5 | 3928 | 7856 | 15712 | 31424 | 47135 | 62847 | 78559 |
| 350 | 3.8 | 4678 | 9355 | 18710 | 37421 | 56131 | 74842 | 93552 |

| | |
|---|---|
| Viscosity calculations | API = 12.0 |
| vo = 10 x − 1 | = 12.2 centipoise |
| x = y(T) − 1.163 | = 1.5 |
| y = 10 z | = 616.1 |
| z = 3.0324 − 0.02023G | = 2.8 |
| G = deg API | = 12.0 |
| T = Temperature, Deg F. | |
| SpGo = Spec. Grav. Crude | = 0.986 |

The equation: BOPD=(0.00708 *k*kor*L*d.PY/(vo*-Bo*in(re/Dw/2); From Calhoun, "Fundamentals of Reservoir Engineering," Section 30, "Darcys Law--Radial Flow";

Where:

BOPD=barrels of oil per day produced from radial flow
L=50 ft. borehole length
Dw=0.5 ft, borehole diameter
d.P=150 psi, differential pressure
k=(variable) md, permeability to air
kor=0.6 relative permeability to oil
vo=(variable) cp, viscosity of crude oil
Bo=1.0 formation volume factor
re=330 ft, drainage radius—each vertical well
B.H.=64 No. of boreholes (wells) for 640 Acres was utilized to determine the production for 64 vertical wells using different permeabilities (resistance to fluid flow through reservoir rocks—the higher the permeability the better) and viscosities of crude oil at different temperatures (the lower the viscosity the better). The model was set up to accept different API gravities and to calculate the crude viscosity at specific temperatures according to the following equations:

| | |
|---|---|
| Viscosity calculations: | API = 12.0 |
| vo = 10 x − 1 | = 12.2 centipoise |
| x = y(T) − 1.163 | = 1.5 |
| y = 10 z | = 616.1 |
| z = 3.0324 − 0.02023G | = 2.8 |
| G = deg API | = 12.0 |
| T = Temperature, Deg F. | |
| SpGo = Spec. Gravity Crude | = 0.986 |

Exhibit B is a tabulation of the results of a computer model of the equation for gravity drainage through a horizontal bore hole, as it relates to the TARHEVCOR process of the present invention: Bore hole BOPD=(1.127e-3 *L*k*kor*Dw*d.P)/(vo)) *B.H.; From Timmerman, "Practical Reservoir Engineering, Vol. 2" Chap. 11, "Gravity Drainage";

Where

BOPD = barrels per day oil production through a horizontal borehole
L = 2600 ft, borehole length
Dw = 0.5 ft, borehole diameter
d.P = 150 psi, gas cap pressure
k = (variable) md, permeability to air
kor = 0.6 relative permeability to oil
vo = (variable) cp, viscosity of oil
B.H. = 48 No. of boreholes for 640 Acres EXHIBIT B
MASEK TARHEVCOR PROJECT
VISCOSITY/PRODUCTION MODEL
GRAVITY DRAINAGE (With Gas Cap Pressure Above)
DRAINAGE AREA: 640 Acres, 50 Ft. Thick Oil Bearing Zone
Borehole BOPD = [(1.127e-3 * L * k * kor * Dw * d.P)/(vo)] * B.H.
[From Timmerman, "Practical Reservoir Engineering, Vol. 2" Chap. 11, "Gravity Drainage"]
Where:

L = 2600 ft, borehole length
Dw = 0.5 ft, borehole diameter
d.P = 150 psi, gas cap pressure
k = (variable) md, permeability to air
kor = 0.6 relative permeability to oil
vo = (variable) cp, viscosity of oil
B.H. = 48 No. of boreholes for 640 Acres

| Est. Fm Temp Tfm deg F. | k = Visc in Fm cp | 50 BOPD from 48 B. holes | 100 BOPD from 48 B. holes | 200 BOPD from 48 B. holes | 400 BOPD from 48 B. holes | 600 BOPD from 48 B. holes | 800 BOPD from 48 B. holes | 1000 BOPD from 48 B. holes |
|---|---|---|---|---|---|---|---|---|
| 70 | 25317.0 | 12 | 25 | 50 | 100 | 150 | 200 | 250 |
| 100 | 808.7 | 391 | 783 | 1565 | 3131 | 4696 | 6261 | 7827 |
| 125 | 174.2 | 1817 | 3633 | 7267 | 14533 | 21800 | 29066 | 36333 |
| 150 | 64.3 | 4922 | 9844 | 19688 | 39377 | 59065 | 78754 | 98442 |
| 175 | 31.9 | 9925 | 19850 | 39700 | 79400 | 119099 | 158799 | 198499 |
| 200 | 18.9 | 16746 | 33492 | 66985 | 133969 | 200954 | 267939 | 334923 |
| 225 | 12.6 | 25179 | 50357 | 100715 | 201430 | 302145 | 402860 | 503575 |
| 250 | 9.0 | 34990 | 69979 | 139958 | 279917 | 419875 | 559833 | 699792 |
| 275 | 6.9 | 45964 | 91928 | 183856 | 367712 | 551568 | 735424 | 919280 |
| 300 | 5.5 | 57919 | 115839 | 231677 | 463354 | 695031 | 936708 | 1158385 |
| 325 | 4.5 | 70705 | 141410 | 282820 | 565640 | 848461 | 1131281 | 1414101 |
| 350 | 3.8 | 84099 | 168399 | 336798 | 673595 | 1010393 | 1347190 | 1683988 |

| Viscosity calculations | API = 12.0 |
|---|---|
| vo = 10 x − 1 | = 12.2 centipoise |
| x = y(T) − 1.163 | = 1.5 |
| y = 10 z | = 616.1 |
| z = 3.0324 − 0.02023G | = 2.8 |
| G = deg API | = 12.0 |
| T = Temperature, Deg F. | |
| SpGo = Spec. Grav. Crude | = 0.986 |

Both Exhibit A and B computer models were set up to drain an area of 640 acres with identical pressure differentials in the reservoir which was 50 feet thick. Permeabilities, viscosities and other oil bearing zone physical characteristics were kept the same in both models.

As can be seen in comparing rates for a given temperature and permeability on the two tables; e.g. 150 deg F. and 100 md, the horizontal boreholes out performed the vertical boreholes by a ratio of 18:1 (9,844 BOPD to 547 BOPD) with this particular set of physical reservoir characteristics. This ratio is constant when comparing any production rate at any specific temperature and permeability on these two tables.

Figure 12:
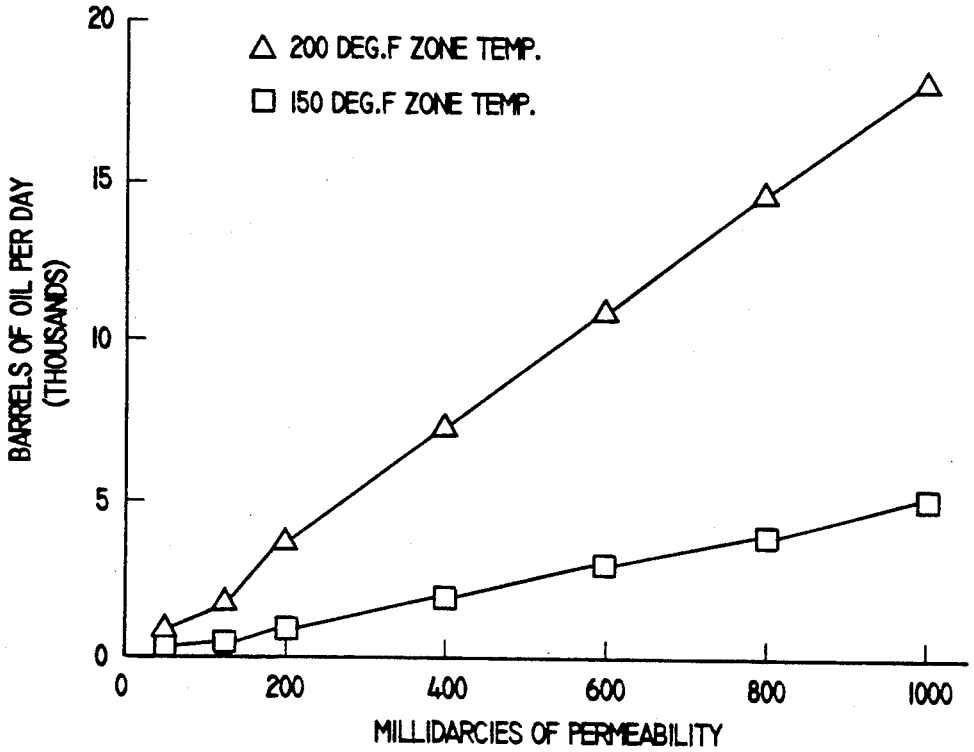
FIG. 12 is a graph of the production rate of a radial flow well.
Figure 13:
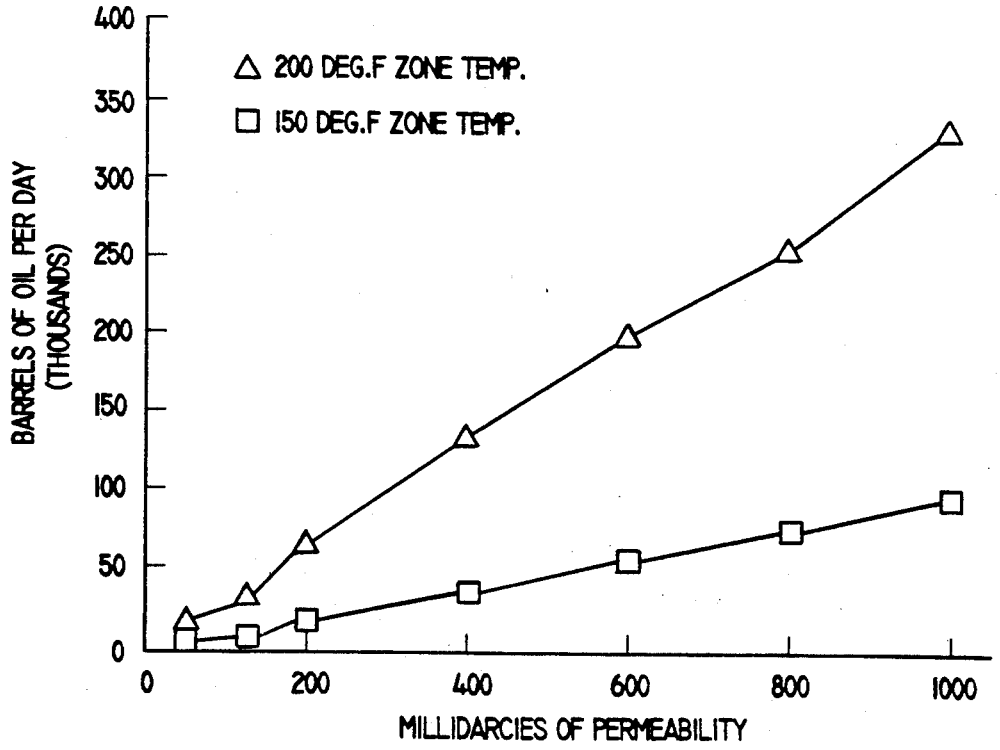
FIG. 13 is a graph of the production rate of a well according to the present invention.

FIGS. 12 and 13 graphically illustrate the difference in producing rates between the two flow processes, which differ essentially in two aspects: (1) geometry of the boreholes (vertical vs. horizontal) and (2) length of boreholes (formation thickness for the vertical wells vs. 2600 feet for the horizontal). Both graphs are plots of BOPD vs. permeability at two different temperatures 150 and 200 degrees Farenheit (with associated improved viscosity).

The foregoing is the preferred embodiment of the invention. Variations and modifications within the scope of the following claims are included herein.

What is claimed is:

1. A method for recovery of oil from porous sub-surface formations comprising:

a) mining a vertical shaft through said formation, b) mining and drilling an upper, horizontal rectangular grid of drift and bore holes outward from said shaft, c) mining and drilling a lower horizontal, rectangular grid of drift and bore holes outward from said shaft, d) applying supper heated, pressurized oil vapor through alternate bore holes of said lower grid to heat said formation, e) simultaneously applying hot, pressurized flue gas through said upper grid to heat said formation and force oil downward, f) condensing said super heated oil vapor in said formation and recovering heated flowable crude oil mixed with said condensed oil vapor through said lower grid, and g) recycling a portion of said recovered crude oil as said super heated, pressurized oil vapor.

wherein said upper and lower grids are oriented in a parallel relationship relative to the dip and strike of said sub-surface formation with said drifts aligned with the dip and said bore holes extending perpendicularly to said drifts and aligned with the strike.

2. The method of claim 1 wherein said super heated pressurized oil vapor is applied to the formation at a pressure of 50–100 PSI.

3. The method of claim 1 wherein said hot, pressurized flue gas is applied to the formation at a pressure greater than the prevailing reservoir pressure.

4. The method of claim 1 wherein said formation is heated to a temperature of 100°–650° F. above the ambient temperature of the formation.

5. The method of claim 1 wherein said super heated pressurized oil vapor is produced from crude oil obtained from said porous sub-surface formation and said hot flue gas is produced in conjunction with super heating of said oil vapor.

6. A method for recovery of oil from deep, porous, sub-surface formations:

a) mining a vertical shaft through the entire depth of said formation, b) mining and drilling a plurality of horizontal rectangular grids of drift and bore holes outward from said shaft at sequential levels in and aligned with the dip and strike of said formation, each sequential pair of girds providing upper and lower boundaries for one interval of said formation, c) applying a super heated pressurized oil vapor through a lower grid of a pair to heat the interval adjacently above.

d) simultaneously applying hot, pressurized flue gas through an upper grid of a pair to force oil downward in the interval adjacently below, e) recovering heated flowable oil mixed with condensed super heated pressurized oil vapor from the interval of said formation through the lower grid of the pair, f) recycling portions of said recovered oil as super heated oil vapor for application to said interval through said lower grid of a pair; wherein said rectangular grids are drilled at at least 50 foot vertical intervals within said formation and are used sequentially from the top of the formation to the bottom to extract oil from each successive interval of formation, the lower grid of one interval becoming the upper grid of the next interval down.

7. The method of claim 6 wherein said super heat pressurized oil vapor is produced from crude oil obtained from said formation by an initial application of hot flue gas.

8. A method for recovery of oil from porous sub-surface formations comprising:

a) mining a vertical shaft through said formation, b) mining and drilling an upper horizontal rectangular grid of drift and bore holes outward from said shaft, c) mining and drilling a lower horizontal rectangular grid of drift and bore hole outward from said shaft d) applying a first hot, pressurized, condensable fluid through alternate bore holes of said lower grid to heat said formation, e) applying a second hot, pressurized, non-condensable fluid through said upper grid to heat said formation and force oil downward, f) recovering heated, flowable oil mixed with said first hot, pressurized, condensable fluid through said lower grid, wherein said upper and lower grids are oriented in a parallel relationship relative to the dip and strike of said sub-surface formation with said drifts aligned with the dip and said bore holes aligned with the strike, and wherein each grid comprises at least one drift extending substantially horizontally from said shaft and a plurality of bore holes extending into said formation from and perpendicular to said drift and wherein said first hot pressurized fluid is super heated crude oil vapor and said second hot pressurized fluid is flue gas, said method further comprising:

g) first applying said flue gas to said formation through said upper grid thereby heating an initial area of said formation and producing a first quantity of crude oil therefrom, h) collecting said first quantity of crude oil, separating a fraction thereof and super heating said fraction to a super heated vapor state, i) applying said super heated crude oil vapor to said formation through alternating bore holes of said lower grid to heat said formation while simultaneously applying flue gas to said formation through said upper grid, whereby said flue gas provides an expanding heat chest in an upper portion of said formation and said super heated crude oil vapor condenses in said formation and mixes with in situ crude oil thereby heating said crude oil and reducing its viscosity whereby said crude oil and entrained condensate is recovered through alternating bore holes of said lower grid, said expanding heat chest serving to drive in situ crude oil downward in said formation toward said lower grid, and j) separating a fraction of said recovered crude oil for continued generation of super heated crude oil vapor applied through said lower grid.

9. The method of claim 8 wherein said flue gas is generated in a facility for and as the result of super heating said crude oil.

10. A method for recovery of oil from deep, porous, sub-surface formations comprising:

a) mining a vertical shaft through the entire depth of a formation, b) mining and drilling a plurality of horizontal rectangular grids of drift and bore holes outward from said shaft at sequential levels in and aligned with the dip and strike of said formation, each sequential pair of grids providing upper and lower boundaries for one interval of said formation, c) applying a first hot, pressurized, condensable fluid through a lower grid of a pair to heat the interval adjacently above, d) applying a second hot, pressurized, non-condensable fluid through an upper grid of a pair to force oil downward in the interval adjacently below, e) recovering heated flowable oil mixed with said condensed first fluid from the interval of said formation through the lower grid of pair, f) separating said recovered oil, and g) recycling portions of said recovered oil;

wherein said rectangular grids are drilled at at least 50 foot vertical intervals within said formation and are used sequentially from the top of said formation to the bottom to extract oil from each successive interval of formation, the lower grid of one interval becoming the upper grid of the next interval downward, and further wherein each of said grids comprises at least one drift mined along the dip of said formation and a plurality of substantially horizontally extending bore holes drilled into said formation perpendicular to said drift and along the strike of said formation, the method further comprising:

h) applying said hot, pressurized condensable fluid to said formation through alternating bore holes of said lower grid, and i) collecting produced crude oil through bore holes intermediate said alternating bore holes, wherein the application of said fluid through said alternating bore holes produces pressure sinks in said formation corresponding to the location of said intermediate bore holes whereby in situ crude oil is caused to migrate to said pressure sinks for collection through said intermediate bore holes.

11. The method of claim 50 wherein said alternating bore holes and said intermediate bore holes are reversed such that said hot pressurized condensable fluid is applied through said intermediate bore holes and said crude oil is produced through said alternating bore holes, said reversal of said bore holes producing a reversal of said pressure sinks whereby production of crude oil from said formation is enhanced.

12. The method of claim 10 wherein said first hot, pressurized, condensable fluid is supper heated crude oil vapor obtained by heating crude oil recovered from said formation and said second hot, pressurized, non-condensable fluid is flue gas produced in conjunction with the heating of said crude oil.

13. The method of claim 10 further comprising recycling portions of said recovered oil as said first hot, pressurized, condensable fluid by heating said portions to vapor phase and super heating said vapor for application through a lower grid of a pair.

14. A method for production of oil from a steeply sloping porous sub-surface formation comprising:

a) mining a vertical shaft from the surface through said formation to a lower level thereof, b) mining a single drift under said formation parallel to and upwardly along the dip of said formation, c) drilling a plurality of substantially horizontal bore holes along and perpendicular to said drift into said formation and parallel to the strike of said formation, d) injecting a hot, pressurized, non-condensable fluid into said formation through said bore holes at an up dip location along said drift, e) recovering an initial flow of crude oil from said up dip bore holes, f) super heating said initial flow of crude oil and injecting said super heated crude oil into said formation through bore holes at a down dip location along said drift, and g) recovering produced crude oil from bore holes intermediate said up dip location and said down dip locations along said drift, whereby said hot, pressurized, non-condensable fluid produces a heat chest in an upper level of said formation which migrates down dip as a pressure front through said formation and whereby said super heated crude oil injected at said down dip location heats in situ crude by conduction and condenses in said crude thereby reducing the viscosity of said crude, said reduced viscosity and said pressurized heat chest combining to force said crude oil out of said formation.

15. The method of claim 14 wherein said hot, pressurized, non-condensable fluid is flue gas.

16. The method of claim 15 wherein said super heated crude oil is injected into said formation in vapor form.

17. The method of claim 16 wherein said flue gas is produced in conjunction with the super heating of said crude oil.

18. The method of claim 14 wherein a portion of said recovered produced crude oil is recycled to said down dip location as super heated crude oil vapor.

* * * * *